US011564290B2

(12) United States Patent
Linares

(10) Patent No.: US 11,564,290 B2
(45) **Date of Patent: *Jan. 24, 2023**

(54) MAGNETIC INDUCTION STYLE FURNACE OR HEAT PUMP INCORPORATING FORCED AIR OR FLUID BLOWERS

(71) Applicant: Heat X, LLC, Auburn Hills, MI (US)

(72) Inventor: Miguel A. Linares, Bloomfield Hills, MI (US)

(73) Assignee: Heat X, LLC, Auburn Hills, MI (US)

( * ) Notice: Subject to any disclaimer, the term of this patent is extended or adjusted under 35 U.S.C. 154(b) by 389 days.

This patent is subject to a terminal disclaimer.

(21) Appl. No.: 16/671,341

(22) Filed: Nov. 1, 2019

(65) Prior Publication Data

US 2020/0068668 A1 Feb. 27, 2020

Related U.S. Application Data

(63) Continuation-in-part of application No. 16/519,437, filed on Jul. 23, 2019.
(Continued)

(51) Int. Cl.
*H05B 6/22* (2006.01)
*F24H 3/10* (2022.01)

(52) U.S. Cl.
CPC ..... *H05B 6/22* (2013.01); *F24H 3/102* (2013.01)

(58) Field of Classification Search
CPC ..... H05B 6/109; H05B 6/108; H05B 6/06; H05B 6/102; H05B 6/16; H05B 6/22;
(Continued)

(56) References Cited

U.S. PATENT DOCUMENTS 2,448,010 A 8/1948 Baker et al.
2,489,939 A 11/1949 Traupel
(Continued)

FOREIGN PATENT DOCUMENTS

JP 2000110772 A * 4/2000
JP 2006316683 A 11/2006
(Continued)

OTHER PUBLICATIONS

International Search Report and Written Opinion for International Application No. PCT/US2019/043341, dated Nov. 13, 2019.
(Continued)

*Primary Examiner* — Tu B Hoang
*Assistant Examiner* — Vy T Nguyen
(74) *Attorney, Agent, or Firm* — Dinsmore & Shohl LLP

(57) ABSTRACT

A magnet blower thermal conditioning system having a housing, a first blower subassembly in communication with a housing inlet for receiving an inlet fluid flow and a second blower subassembly in communication with the first blower subassembly as well as a housing outlet. Each of the blower subassemblies includes a sleeve shaped support, a plurality of spaced apart magnetic or electromagnetic plates extending radially from the sleeve supports. Conductive components are rotatably supported about the sleeve shaped supports, each incorporating a plurality of linearly spaced and radially projecting conductive plates which alternate with the pluralities of spaced and radially supported magnetic or electromagnetic plates. A motor or input drive rotates the conductive components relative to the magnetic/electromagnetic plates, creating high frequency oscillating magnetic fields and thermally conditioning the fluid flow as it is communicated in succession through the first and second blower subassemblies and through the housing outlet.

9 Claims, 5 Drawing Sheets

Related U.S. Application Data

(60) Provisional application No. 62/757,265, filed on Nov. 8, 2018, provisional application No. 62/703,128, filed on Jul. 25, 2018.

(58) Field of Classification Search
CPC ..... F24H 3/102; F24D 2200/08; F24F 11/67; F24F 5/00; F25B 21/00; F25B 2321/0022; F25B 2321/0023; Y02B 30/00
USPC ..... 219/631, 628, 672, 513, 530, 540, 600, 219/630, 156, 601, 618, 629, 654, 670, 219/78.01; 165/129, 182, 55, 185; 415/1, 169.1, 199.1, 199.2, 211.2, 58.2; 417/405, 423.9, 424.1; 310/195, 201, 310/211, 215, 216.118, 216.136, 261.1, 310/265, 422, 427, 431, 59; 123/2
See application file for complete search history.

(56) References Cited

U.S. PATENT DOCUMENTS

| | | | | |
|---|---|---|---|---|
| 3,014,116 | A | 12/1961 | MacArthur | |
| 4,512,289 | A | 4/1985 | Collins | |
| 5,334,819 | A | 8/1994 | Lin | |
| 5,914,065 | A * | 6/1999 | Alavi | H05B 6/108 219/630 |
| 6,144,020 | A | 11/2000 | Usuiu et al. | |
| 6,297,484 | B1 * | 10/2001 | Usui | F24V 99/00 219/628 |
| 7,339,144 | B2 | 3/2008 | Lunneborg | |
| 7,420,144 | B2 | 9/2008 | Lunneborg | |
| 8,283,615 | B1 | 10/2012 | Albertson | |
| 8,373,103 | B2 * | 2/2013 | Waldner | F02M 31/042 392/397 |
| 8,418,832 | B1 * | 4/2013 | Albertson | F25B 15/00 219/628 |
| 8,616,016 | B2 * | 12/2013 | Asano | H02K 21/14 62/238.7 |
| 8,844,706 | B2 | 9/2014 | Albertson et al. | |
| 9,278,414 | B2 | 3/2016 | Haimer | |
| 9,544,945 | B2 | 1/2017 | Hadoulias et al. | |
| 9,631,252 | B2 | 4/2017 | Chatterjee et al. | |
| 9,883,552 | B2 * | 1/2018 | Nangle | H05B 6/108 |
| 10,425,998 | B2 * | 9/2019 | Nangle | H05B 6/109 |
| 2002/0070621 | A1 * | 6/2002 | Mori | H02K 3/30 310/215 |
| 2003/0066830 | A1 | 4/2003 | Reed et al. | |
| 2005/0039830 | A1 | 2/2005 | Christofis et al. | |
| 2005/0263522 | A1 * | 12/2005 | Lunneborg | H05B 6/108 219/672 |
| 2006/0086729 | A1 | 4/2006 | Lunneborg | |
| 2009/0223948 | A1 | 9/2009 | Hess | |
| 2011/0215089 | A1 | 9/2011 | Garza | |
| 2013/0062340 | A1 | 3/2013 | Hsu | |
| 2015/0001208 | A1 | 1/2015 | Albertson et al. | |
| 2017/0175770 | A1 * | 6/2017 | Waldner | F04D 17/08 |
| 2018/0094869 | A1 * | 4/2018 | Reshetnyak | F28F 9/001 |
| 2018/0176999 | A1 * | 6/2018 | Wilhelm Bavesteello | H05B 6/108 |

FOREIGN PATENT DOCUMENTS

| | | | |
|---|---|---|---|
| KR | 20090081981 | A | 7/2009 |
| WO | 2006058404 | A1 | 6/2006 |
| WO | 2014137232 | A1 | 9/2014 |
| WO | 2015074645 | A1 | 5/2015 |
| WO | 2019193122 | A1 | 10/2019 |

OTHER PUBLICATIONS

International Search Report and Written Opinion for International Application No. PCT/US2019/045847; dated Nov. 28, 2019.

* cited by examiner

MAGNETIC INDUCTION STYLE FURNACE OR HEAT PUMP INCORPORATING FORCED AIR OR FLUID BLOWERS

CROSS REFERENCE TO RELATED APPLICATIONS

The present application claims the priority of U.S. Ser. No. 62/757,265 filed Nov. 8, 2018. The present application is also a continuation in part of U.S. Ser. No. 16/519,437 filed Jul. 23, 2019 which claims the benefit of 62/703,128 filed Jul. 25, 2018.

FIELD OF THE INVENTION

The present invention relates generally to a magnetic/electromagnetic heating or cooling assemblies. More specifically, the present invention discloses a magnetic heat generating furnace or heat pump which incorporates single or multiple blower sub-assemblies, each of which includes a rotary heat convective plate, and such as integrated in multiple-tiered fashion within a drum-shaped component, and which is provided in combination with any number of proximally spaced, length alternating and circumferential magnet or electromagnet arrays. Rotation of the conductive plates relative to the magnet/electromagnet arrays results in the magnets generating a high-frequency oscillating magnetic field that causes the magnet's polarity to switch back and forth at a sufficient rate to produce friction, such being conducted into the proximally-located heat conductive plate, the plate in a preferred embodiment rotating relative to a fixed magnetic array, and so that directing vanes incorporated into the rotating plate(s) facilitate the generated heat being redirected out through an outlet of a surrounding cabinet housing associated with a furnace application.

BACKGROUND OF THE INVENTION

The concept of generating heat from magnets is generally known in the art and results from placing the magnetic material into a high-frequency oscillating magnetic field that causes the magnet's polarity switch back and forth at a high-enough rate to produce noticeable friction which is given off in the form of heat. As is further known, such an oscillating field can result from rotating the magnet at speed relative to proximally-located metal conductive element.

Other prior art induction heater devices include an electronic oscillator which passes a high-frequency alternating current through an electromagnet in order to generate eddy currents flowing through the resistance of the material. In this fashion, the eddy currents result in a high-frequency oscillating magnetic field which causes the magnet's polarity to switch back and forth at a high-enough rate to produce heat as byproduct of friction.

One known example of a prior art induction heating system is taught by the electromagnetic induction air heater of Garza, US 2011/0215089, which includes a conductive element, a driver coupled to the conductive element, an induction element positioned close to the conductive element, and a power supply coupled to the induction element and the driver. Specifically, the driver applies an angular velocity to rotate the conductive element about a rotational axis. The power supply provides electric current to the induction element to generate a magnetic field about the induction element such that the conductive element heats as it rotates within the magnetic field to transfer heat to warm the cold air flow streams. The cold air flow streams are circulated about the surface of the conductive element and directed by the moving conductive element to generate warm air flow streams from the conductive element.

Also referenced is the centrifugal magnetic heating device of Hsu 2013/0062340 which teaches a power receiving mechanism and a heat generator. The power receiving mechanism further includes a vane set and a transmission module. The heat generator connected with the transmission module further includes a centrifugal mechanism connected to the transmission module, a plurality of bases furnished on the centrifugal mechanism, a plurality of magnets furnished on the bases individually, and at least one conductive member corresponding in positions to the magnets. The vane set is driven by nature flows so as to drive the bases synchronically with the magnets through the transmission module, such that the magnets can rotate relative to the conductive member and thereby cause the conductive member to generate heat.

SUMMARY OF THE PRESENT INVENTION

The present invention discloses a magnet/electromagnet blower thermal conditioning system having a housing, a first blower subassembly arranged in the housing in communication with a housing inlet for receiving an inlet fluid flow. A second blower subassembly is arranged in the housing in communication with the first blower subassembly, the second blower subassembly also being in communication with a housing outlet. Without limitation, the first and second blower subassemblies can vertically tiered with the housing inlet at a lower end and the housing outlet at an upper end.

In a first variant, each of the blower subassemblies includes a sleeve shaped support, a plurality of spaced apart magnetic or electromagnetic plates extending radially from the sleeve supports. A conductive component is rotatably supported about the sleeve shaped supports, each of the conductive components incorporating a plurality of linearly spaced apart and radially projecting conductive plates which alternate with the pluralities of spaced and radially supported magnetic or electromagnetic plates. At least one motor or input drive rotates the conductive components relative to the magnetic or electromagnetic plates, creating high frequency oscillating magnetic fields and thermally conditioning the fluid flow as it is communicated in succession through the first and second blower subassemblies and through the housing outlet.

Additional features include the conductive plates each exhibiting an array of channeling and redirecting vanes for pushing the heated/cooled air or fluid flow through the outlet. Brackets extend from the sleeve shaped support to end mounting locations within the housing, a cylindrical outer wall extending between the mounting locations defining an outer cylindrical chamber surrounding the magnetic or electromagnetic plates. The conductive component further includes end walls and an interconnecting second cylindrical wall interconnecting each of the conductive plates and extending around the magnetic or electromagnetic plates to define an inner cylindrical chamber within the outer cylindrical chamber.

A further reconfigured variant of the blower subassemblies can include a modified shaped conductive component having modified air or fluid flow redirecting vanes to include each of a first inner plurality of circumferentially arrayed vanes and a second outer plurality of circumferentially arrayed vanes. Air or fluid regulating baffles are located between the inner and outer pluralities of vanes to facilitate continuous movement of air or fluid flow within the conductive component and to prevent air or fluid flow from exiting too quickly through the outlet. A static air or fluid recirculating fan is secured against the inner circumferentially arrayed vanes for assisting in redirecting air or fluid flow between the fan inlet and a radially located outlet.

Without limitation, the configuration and material selection for each of the conductive plates are such that they can be selected from any conductive materials which can include varying patterns of materials, bi-materials or multi-materials designs, such including any of metals or alloys, ceramics or any metal ceramic composite materials with ferromagnetic, ferromagnetic, antiferromagnetic, paramagnetic or diamagnetic properties.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
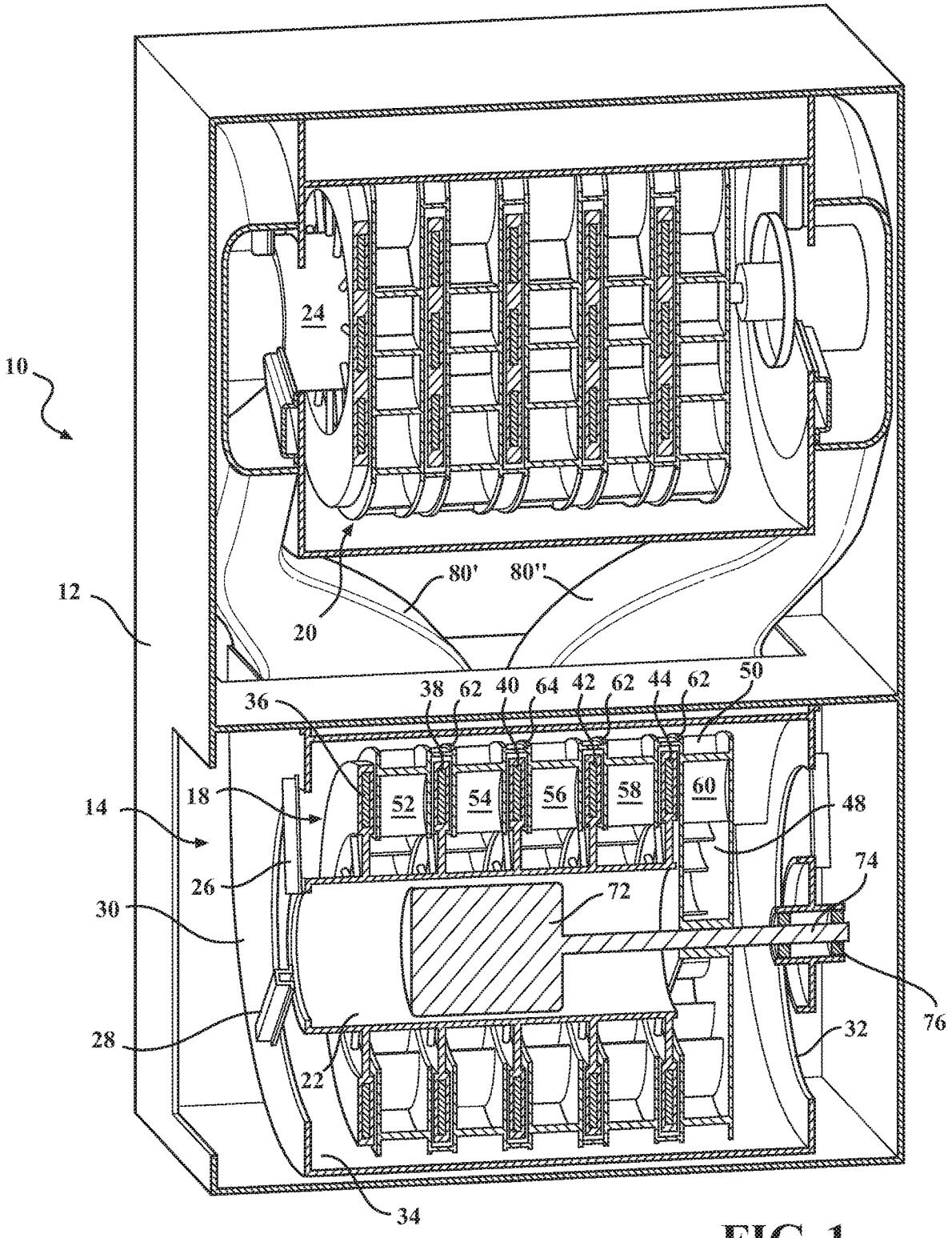
FIG. 1 is a perspective length cutaway of a furnace or heat pump design with dual magnet or electromagnetic heat generating blower subassemblies arranged in a tiered fashion and in which the second blower subassembly substitutes for a conventional heat exchanger, each including a fixed axial extending sleeve with open interior channel and supporting a plurality of spaced magnetic plates, an elongated conductive component rotatably supported about the sleeve, the conductive component incorporating a plurality of linearly spaced apart and radially projecting circular plates which alternate with the axially spaced and radially supported fixed magnetic plates such that, upon rotation the conductive plates, each results in the friction resulting from the oscillating magnetic fields of the magnets being given off as heated air or fluid between the magnetic plates and conductive plates for conducting into the rotating plates and eventual delivery through an outlet orifice of the furnace/heat pump housing.
Figure 2:
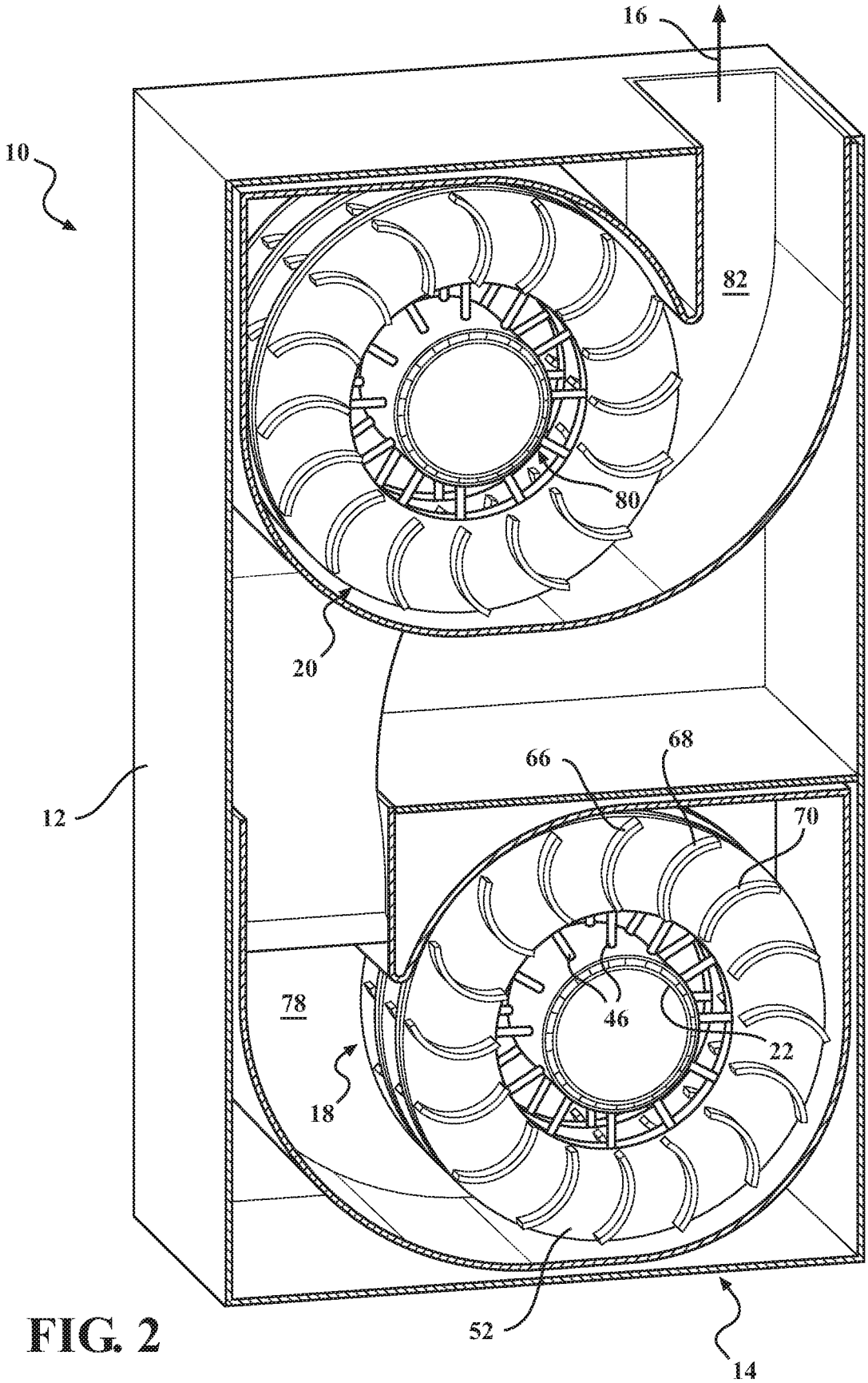
FIG. 2 is a rotated and width perspective cutaway of the furnace of FIG. 1 and showing the direction of the first end fluid or air intake, first and second magnetic heat blower subassemblies with circumferential vane configurations associated with the rotating conductive elements and twice thermally conditioned (heated or cooled) second end treated fluid or air output.

With reference to the subsequent illustrations, the present invention discloses a dual stage furnace or heat pump incorporating first and second (typically lower and upper tiered) magnet/electromagnet subassemblies which are integrated into a housing or cabinet. FIGS. 1-2 depict a first variant of blower subassembly, with subsequent FIGS. 3-6 depicting a further variant of blower subassembly.

With initial reference to FIGS. 1-2, the present invention discloses a magnet heat generating furnace or heat pump, generally illustrated at 10, according to a first non-limiting variant of the present invention. FIG. 1 depicts a perspective length cutaway of the furnace having a three dimensional, typically rectangular, cabinet 12 having a first side located inlet 14 and a second top end located outlet 16. The cabinet contains a pair of magnet or electromagnet heat generating blower assemblies, shown at 18 and 20 which are arranged in a tiered fashion and in which the second, upper located blower assembly 20 can substitute for a conventional heat exchanger.

As further shown, each blower 18 and 20 includes a fixed axial extending sleeve, at 22 for lower blower 18 and at 24 for upper blower 20. Both of the blowers are substantially identical in construction, with the lower blower 18 further depicted in length cutaway to permit a more detailed description as to its working components.

The central support 16 of the lower blower assembly 18 is fixedly mounted in the variant of FIG. 1 by brackets (see at 26 and 28) extending from the sleeve to outer mounting locations (see opposite end mounting plates 30 and 32 and outer cylindrical enclosure wall 34 which define a cylindrical interior chamber within the cabinet 12). A plurality of spaced magnetic or electromagnetic plates are depicted in one non-limiting arrangement at 36, 38, 40, 42 and 44, arranged in axially spaced apart fashion and extending radially outwardly from the central sleeve 22 (without limitation the magnetic or electromagnetic plates can be solid or can include an outermost disk portion from which extend radial rib supports as further shown at 46 for selected plate 36).

An elongated conductive component (also partially depicted in cutaway) includes an elongated body rotatably supported about the sleeve 22 and between the magnetic/electromagnetic plates 36-44. The conductive component defines a further cylindrical chamber (see selected end wall 48 not cutaway and outer connecting enclosure defining wall 50, also termed a second cylindrical wall interconnecting each of a plurality of individual conductive plates (at 52, 54, 56, 58 and 60 arranged in alternating fashion with the magnetic plates 36, 38, 40, 42 and 44). The inner cylindrical wall 50 interconnecting the conductive plates is further configured (see annular projecting locations 62, 64, et seq., to extend around and enclose the magnetic/electromagnetic plates 36-44 and to define an inner cylindrical chamber within the outer cylindrical chamber.

The rotated perspective cutaway of FIG. 2 illustrates a surface profile of a selective conductive plate 48 according to one non-limiting design (and such as which can be taken from a rotated and further cutaway of a housing such as shown in FIG. 1). The conductive plate as depicted in the lower subassembly includes an outer disk shaped body having a plurality of outer circumferential curved shaped vanes 66, 68, 70 et seq. The present invention further contemplates the air or other fluid inlet being separate from the magnetic/electromagnet plate support sleeve 22 and by which fluid admittance is provided a location between the outside of the sleeve and the open interior of the magnetic plates as separated by the radial rib supports 46 (and as further depicted by inlet 14 as shown in FIG. 1).

In combination with the other features of the conductive plates, the vanes 66, 68, 70, et seq., operate during rotation of the conductive element and all of the spaced conductive plates, to outwardly influence (push) the inductive heated air or fluid resulting from the oscillating fields generated by the inter-rotation between the magnets/electromagnets and conductive plates, this frictionally heating the air or fluid surrounding magnets as well as the conductive plates, with the result of the fluid/air being heated as it is directed/guided through the blower subassemblies upwardly and out through the top of the housing (again at exit 16 in FIG. 2).

A motor or input drive 72 (see again lower blower assembly 18 in FIG. 1) or like rotational inducing component is provided with an extending stem 74 and is configured to rotate the conductive element (spaced apart plates 52-60 relative to the inter-spaced and stationary magnetic plates 36-44) and associated conductive plates according to a given rotational speed. This is again to both induce the oscillating magnetic fields of each circumferential magnet/electromagnet array in order to generate heat, with the redirecting architecture of the conductive plates operating to concurrently draw outwardly and redirect the air or fluid drawn in from the inlet 14, across the magnetic/electromagnetic plates in conductive heating fashion, and out the furnace exit 16.

The shaft is depicted at a channeled location 76 in the example of FIG. 1 and so that the motor or input drive 72 can define an interior powered component which rotatably drives the conductive element and further such that the channeled interior 22 of the sleeve is reserved for drive componentry, with the fluid/air inlet 14 being communicated to an exterior location of the central sleeve 22 between the sleeve and the individual outer disk shaped location of each of the magnetic plates (corresponding again to axial passage through the radial ribs 46 supporting each outer magnetic circular/disk shaped plate).

Viewing FIGS. 1-2 collectively, a heated/cooled air or fluid outlet of the first (lower) blower 18 is directed at a ductwork location location 78 in an ascending direction to a further communicating ductwork location 80 (FIG. 2) corresponding to an inlet of the upper/second blower assembly 20. The upper outlet of the first/lower blower 18 can be split at locations 80' and 80" so that the initially heated/cooled air or fluid flow from the lower blower 18 can be fed inwardly from both ends of the upper blower subassembly 20 to optimize the heating/cooling of the dual heating/cooling cycle prior to outputting through the upper located housing outlet 16.

As previously described, the upper blower subassembly 20 is similarly constructed to the lower blower assembly 18 such that a repetitive description is unnecessary. The outlet location 82 of the second blower represents a repetitively heated/cooled fluid or air flow which, upon being passed through housing outlet location 16, is thermally conditioned and, without limitation, in one variant can be at a temperature greater than, and upwards of twice the air or fluid flow temperature at the lower outlet 78 associated with the lower/first blower subassembly 18.

Figure 3:
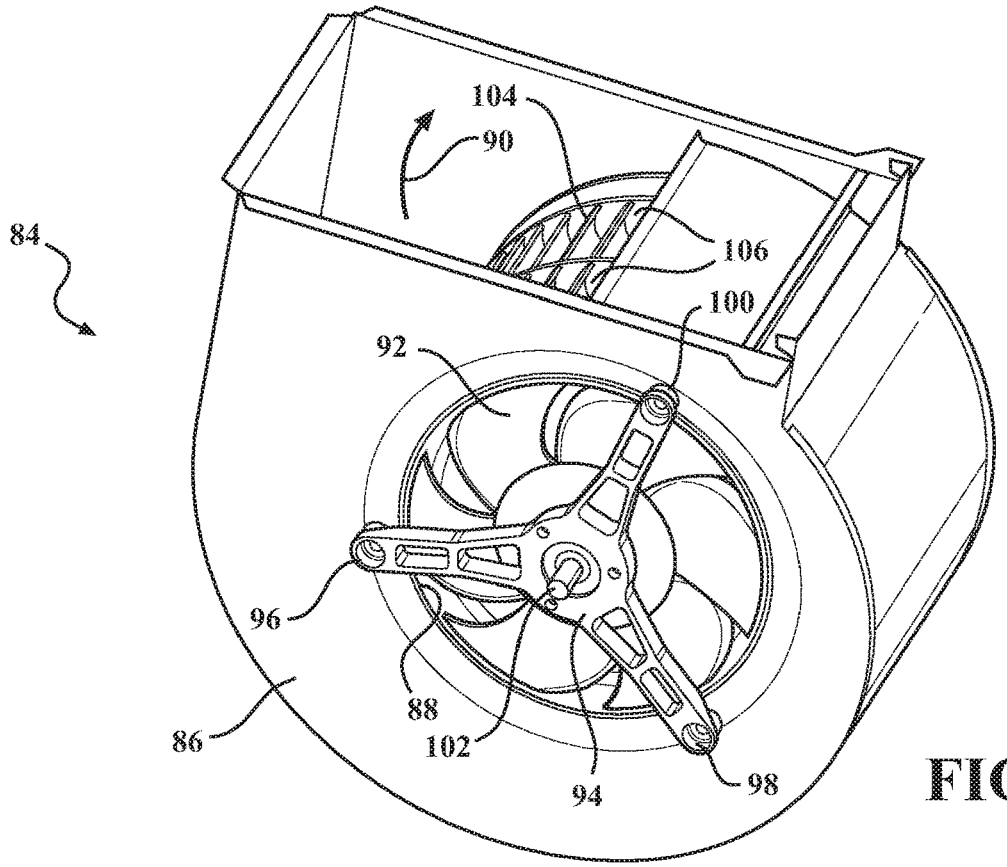
FIG. 3 is a detached perspective of a selected magnet/electromagnet heat/cold blower subassembly according to a further embodiment and which can be integrated in tiered fashion within a housing such as depicted in FIG. 1.
Figure 4:
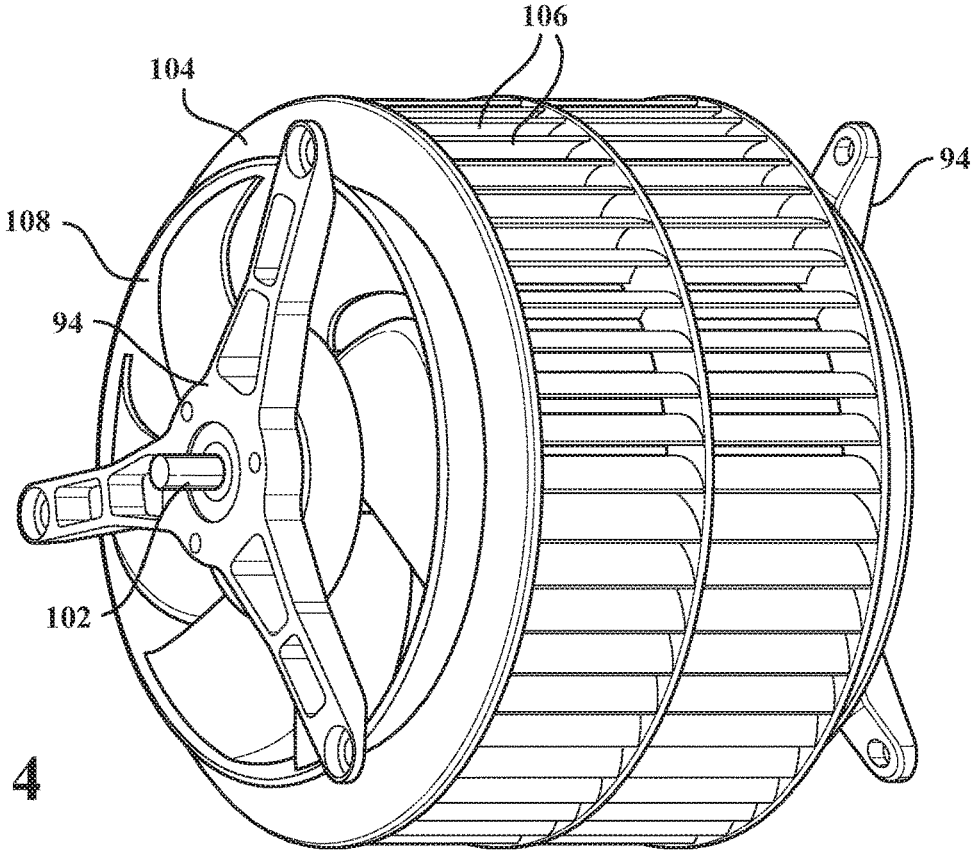
FIG. 4 is a succeeding illustration to FIG. 3 and showing the combination fixed magnet/electromagnet and inter-rotating conductive plates removed from the outer blower housing.

Proceeding to FIG. 3 a detached perspective is generally shown at 84 of a selected magnet/electromagnet heat/cold blower subassembly according to a further embodiment and which includes a housing 86, such as exhibiting a modified cylindrical shape, with a first side located aperture (see inner rim 88) defined inlet and a crosswise directed outlet (see further directional arrow 90). Without limitation, blower subassembly 84 can be provided in a vertically stacked or paired fashion within a suitably reconfiguration of the housing in FIGS. 1-2 and in order to replicate the functionality of the lower 18 and upper 20 blower subassemblies. Additional variants also envision the blower subassembly 84 being provided either as a stand-alone unit or integrated in other pluralities (e.g. ganged fashion) within any suitable reconfiguration of a housing A multi-blade intake fan is shown at 92 is positioned within the rim defined opening. A tripod shaped bracket 94 is provided and is secured, such as with fasteners, at distal end locations 96, 98 and 100 to each opposite side of the housing 86 and so that a shaft 102, powered by a separate motor or other rotating drive input, is supported within a central width extending location through an interior of the blower housing 86.

Figure 5:
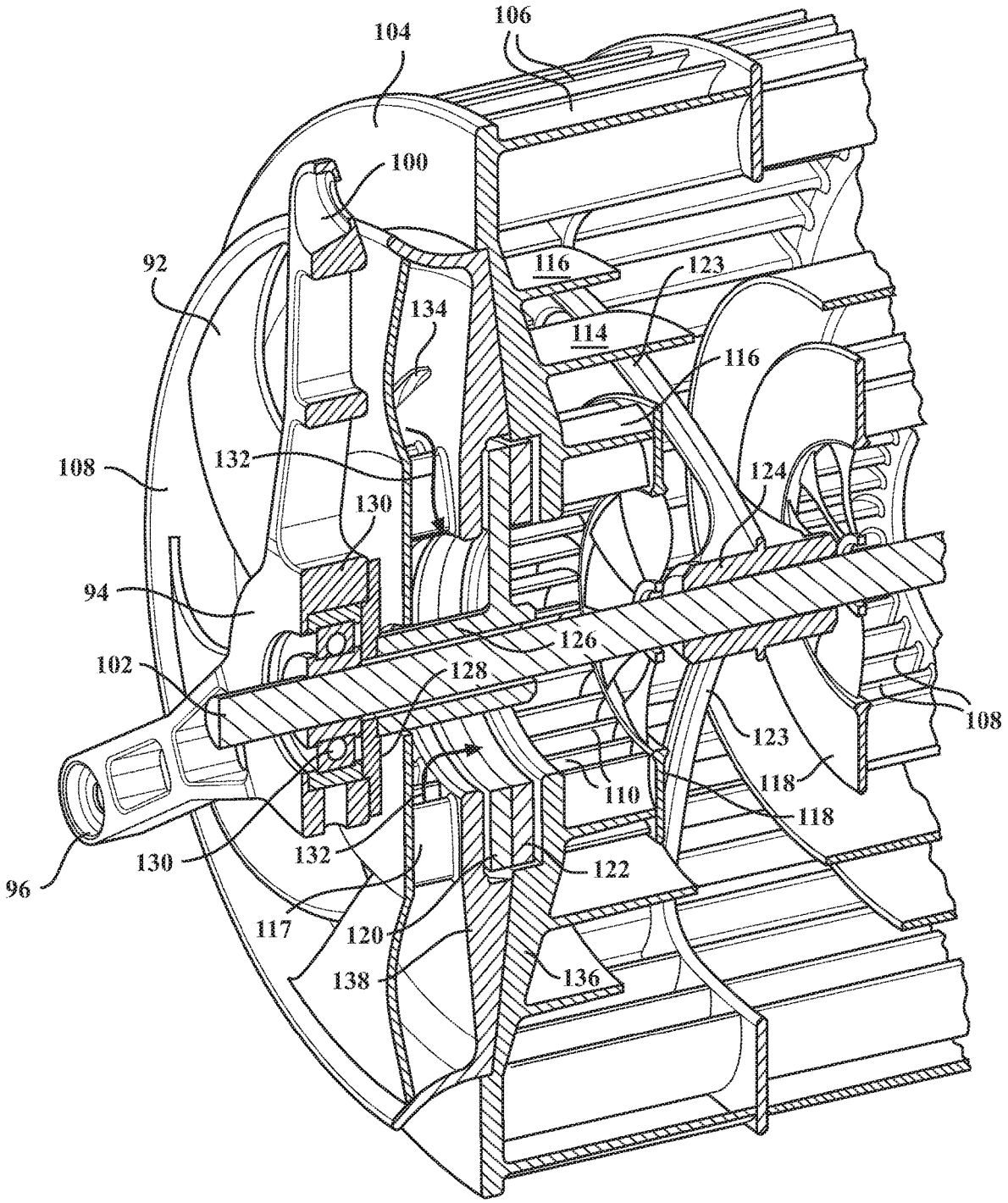
FIG. 5 is a length perspective cutaway of the magnet/electromagnet heat/cold blower subassembly of FIG. 3 and illustrating an air or fluid intake fan and concurrent rotating conductive plates with integrated and circumferentially directed air or fluid redirecting vanes, these relative to a stationary positioned magnet or electromagnet plate array.
Figure 6:
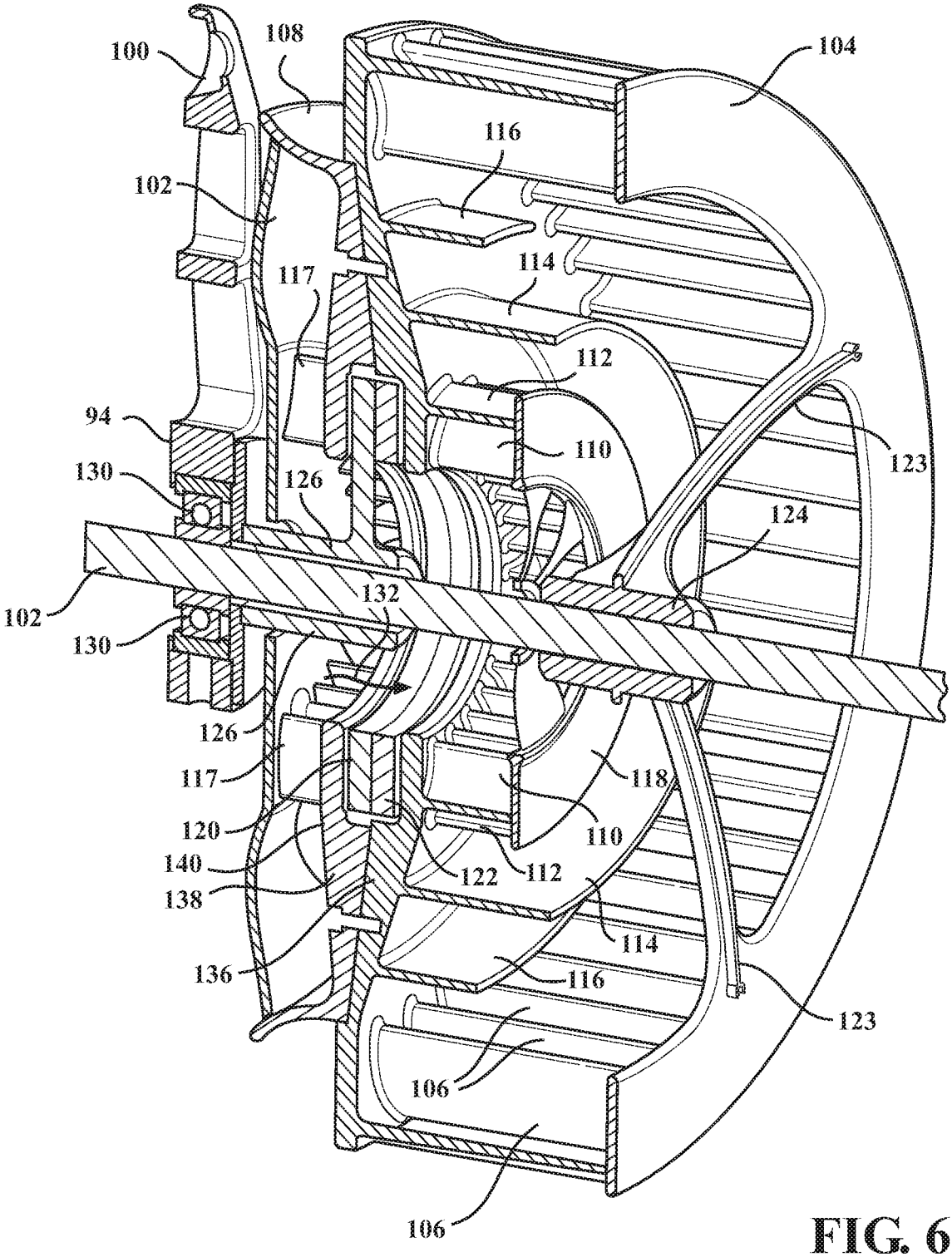
FIG. 6 is a slightly rotated perspective cutaway similar to FIG. 5 and better showing the inner and outer radially tiered vane patterns integrated into the rotating conductive plates for assisting in creating a continuous air or fluid passageway for drawing the magnet or electromagnet inducted heating profile through the circumferential exterior of the rotating blower plates, additional static air or fluid recirculating fan blades being located between the central support shaft and inner radial tier of vane patterns to facilitate continuous drawing of heated air or fluid from a zone proximate the heating magnet array.

A drum shaped combination conductive and air or fluid redirecting component is shown at 104 and is rotatably supported to the central rotating shaft 102 (reference further being made to FIGS. 5-6). As will be further described, the drum component 104 includes inner and outer radially disposed and circumferentially extending air or fluid flow directing vanes, the outer arcuate pattern of the air or fluid flow redirecting vanes being shown 92 at 106 in FIGS. 4-5. As described herein, the present invention utilizes the side disposed fan blade 92 in concurrent rotating fashion with the conductive drum 104 and fan support shroud 108.

FIG. 5 is a length perspective cutaway of the magnet heat/cold blower subassembly of FIG. 3 and illustrating the air or fluid intake fan 92 and concurrent rotating conductive plates (constructed as a drum shaped element 104). The conductive drum 104 again illustrates the integrated and circumferentially directed air or fluid redirecting vanes, again showing the outer circumferentially arrayed arcuate vanes 106 and further illustrating in cutaway each of an inner circumferential array 110 of arcuate vanes, along with a spiraling intermediate array of vanes 112, 114, 116. The shroud 108 further includes additional inner radial and circumferentially arrayed vanes 117 between the inside of the fan blades 92 and the radial surface of the shroud to further assist in redirection of air or fluid flow across the magnet arrays and eventually circumferentially outward through the blower exit 90.

Also shown are static air or fluid recirculating fans 118 located between the central support shaft 102 and the inner radial tier of vane patterns 110 to facilitate continuous drawing of heated/cooled air or fluid from a zone proximate the heating magnet array, this being represented by stationary magnet arrays 120 and 122. The cylindrical drum shaped element 104, support shroud 108, fan 92 and static air or fluid recirculating fans 118 are all secured to the shaft 102 (see inner radial extending members 123 which located central clamp supports 124), whereas the magnet arrays 120 and 122 are secured, via an interior sleeve 126 coaxially surrounding the interiorly rotating shaft 102, to an end flange 128 anchored to each tripod bracket 94. The shaft 102 is further supported between the tripod end brackets 94 via a bearing support array 130.

In operation, the rotation of the drum element 104, shroud 108 and fan 92 cause the intake air or fluid flow to be communicated by the fan in directions 132 across a middle interior of the magnet/electromagnet arrays 120/122. Additional smaller sized cooling vents are shown at 134 within the support shroud 108 which facilitate the passage of additional air or fluid flows in and around the magnet/electromagnet plate arrays 120/122. The thickness of a side wall 136 of the drum element 104, and adjoining wall location 138 of the shroud 108 is greatest proximate the magnetic/electromagnetic plate arrays 120/122 in order to maximize the heat conductivity generated from the magnet/electromagnet arrays which is then convected to the proximal air or fluid flow patterns generated from the intake fan 92. The static air or fluid recirculating fans 118 assist in moving the magnetic/electromagnetic thermally conditioned fluid or air or fluid flow back into the heating/conditioning flow passageways for eventual redirection along further radially outward directed patterns for outflow through exit direction 90 (again FIG. 3) of the blower housing.

Finally, FIG. 6 is a slightly rotated perspective cutaway similar to FIG. 5 and better showing the inner and outer radially tiered vane patterns 110 integrated into the rotating conductive plates (drum shaped element 104) for assisting in creating a continuous air or fluid passageway for drawing the magnet/electromagnetic inducted heating profile through the circumferential exterior of the rotating blower plates. The air or fluid regulating baffles (spiraled patterns 112, 114, 116) assist in maintaining movement of the air or fluid inside the blower assembly, while also inhibiting the air or fluid from exiting the blower too quickly thereby ensuring maximum heat/cold transfer from the conductive arrays located proximate the magnets/electromagnets 120/122. The zone of maximum heat/cold transfer is further shown at 140 at the thickened locations of the conductive rotating drum side wall 136 and affixed side wall 138 of the fan support shroud 108.

As previously described, other and additional envisioned applications can include adapting the present technology for use in magnetocaloric heat pump (MHG) applications, such utilizing a magneto-caloric effect (MCE) provide either of heating or cooling properties resulting from the magnetization (heat) or demagnetization (cold) cycles. The goal in such applications is to achieve a coefficient of performance (defined as a ratio of useful heating or cooling provided to work required) which is greater than 1.0. In such an application, the system operates to convert work to heat as well as additionally pumping heat from a heat source to where the heat is required (and factoring in all power consuming auxiliaries). As is further known in the relevant technical art, increasing the COP (such as potentially to a range of 2.0-3.5 or upwards) further results in significantly reduced operating costs in relation to the relatively small input electrical cost required for rotating the conductive plate(s) relative to the magnetic plate(s). Magnetic refrigeration techniques result in a cooling technology based on the magneto-caloric effect and which can be used to attain extremely low temperatures within ranges used in common refrigerators, such as without limitation in order to reconfigure the present system as a fluid chiller, air or fluid cooler, active magnetic regenerator or air conditioner.

As is further known in the relevant technical art, the magneto-caloric effect is a magneto-thermodynamic phenomenon in which a temperature change of a suitable material is again caused by exposing the material to a changing magnetic field, such being further known by low temperature physicists as adiabatic (defined as occurring without gain or loss of heat) demagnetization. In that part of the refrigeration process, a decrease in the strength of an externally applied magnetic field allows the magnetic domains of a magneto-caloric material to become disoriented from the magnetic field by the agitating action of the thermal energy (phonons) present in the material.

If the material is isolated so that no energy is allowed to (re)migrate into the material during this time, (i.e., again the adiabatic process) the temperature drops as the domains absorb the thermal energy to perform their reorientation. The randomization of the domains occurs in a similar fashion to the randomization at the curie temperature of a ferromagnetic, ferrimagnetic, antiferromagnetic, paramagnetic or diamagnetic material, except that magnetic dipoles overcome a decreasing external magnetic field while energy remains constant, instead of magnetic domains being disrupted from internal ferromagnetism, ferrimagnetism, antiferromagnetism, (or either of paramagnetism/diamagnetism) as energy is added. Applications of this technology can include, in one non-limited application, the ability to heat a suitable alloy arranged inside of a magnetic field as is known in the relevant technical art, causing it to lose thermal energy to the surrounding environment which then exits the field cooler than when it entered.

Other envisioned applications include the ability to generate heat for conditioning any fluid (not limited to water) utilizing either individually or in combination rare earth magnets placed into a high frequency oscillating magnetic field as well as static electromagnetic field source systems including such as energized electromagnet assemblies which, in specific instances, can be combined together within a suitable assembly not limited to that described and illustrated herein and for any type of electric induction, electromagnetic and magnetic induction application. It is further envisioned that the present assembly can be applied to any material which is magnetized, such including any of diamagnetic, paramagnetic, and ferromagnetic, ferrimagnetic or antiferromagnetic materials without exemption also referred to as magnetocaloric materials (MEMs).

Additional factors include the ability to reconfigure the assembly so that the frictionally heated fluid existing between the overlapping rotating magnetic and stationary fluid communicating conductive plates may also include the provision of additional fluid mediums (both gaseous and liquid state) for better converting the heat or cooling configurations disclosed herein. Other envisioned applications can include the provision of capacitive and resistance (ohmic power loss) designs applicable to all materials/different configurations as disclosed herein.

The present invention also envisions, in addition to the assembly as shown and described, the provision of any suitable programmable or software support mechanism, such as including a variety of operational modes. Such can include an Energy Efficiency Mode: step threshold function at highest COP (at establish motor or input drive rpm) vs Progressive Control Mode: ramp-up curve at different rpm/COPs).

Other heating/cooling adjustment variables can involve modifying the degree of magnetic friction created, such as by varying the distance between the conductive fluid circulating disk packages and alternating arranged magnetic/electromagnetic plates. A further variable can include limiting the exposure of the conductive fluid (gas, liquid, etc.,) to the conductive component/linearly spaced disk packages, such that a no flow condition may result in raising the temperature (and which can be controllable for certain periods of time).

As is further generally understood in the technical art, temperature is limited to Curie temperature, with magnetic properties associated with losses above this temperature. Accordingly, rare earth magnets, including such as neodymium magnets, can achieve temperature ranges upwards of 900° C. to 1000° C.

Ferromagnetic, ferrimagnetic, antiferromagnetic, paramagnetic or diamagnetic materials, such as again which can be integrated into the conductive plates, can include any of Iron (Fe) having a Curie temperature of 1043° K (degrees Kelvin), Cobalt (Co) having a Curie temperature of 1400° K, Nickel (Ni) having a Curie temperatures of 627° K and Gadolinium (Gd) having a Curie temperature of 292° K.

According to these teachings, Curie point, also called Curie Temperature, defines a temperature at which certain magnetic materials undergo a sharp change in their magnetic properties. In the case of rocks and minerals, remanent magnetism appears below the Curie point—about 570° C. (1,060° F.) for the common magnetic mineral magnetite. Below the Curie point—by non-limiting example, 770° C. (1,418° F.) for iron—atoms that behave as tiny magnets spontaneously align themselves in certain magnetic materials.

In ferromagnetic materials, such as pure iron, the atomic magnets are oriented within each microscopic region (domain) in the same direction, so that their magnetic fields reinforce each other. In antiferromagnetic materials, atomic magnets alternate in opposite directions, so that their magnetic fields cancel each other. In ferrimagnetic materials, the spontaneous arrangement is a combination of both patterns, usually involving two different magnetic atoms, so that only partial reinforcement of magnetic fields occurs.

Given the above, raising the temperature to the Curie point for any of the materials in these three classes entirely disrupts the various spontaneous arrangements, and only a weak kind of more general magnetic behavior, called paramagnetism, remains. As is further known, one of the highest Curie points is 1,121° C. (2,050° F.) for cobalt. Temperature increases above the Curie point produce roughly similar patterns of decreasing paramagnetism in all three classes of materials such that, when these materials are cooled below their Curie points, magnetic atoms spontaneously realign so that the ferromagnetism, antiferromagnetism, or ferrimagnetism revives. As is further known, the antiferromagnetic Curie point is also referenced as the Néel temperature.

Other factors or variable controlling the temperature output can include the strength of the magnets/electromagnets which are incorporated into the plates, such as again by selected rare earth magnets having varying properties or, alternatively, by adjusting the factors associated with the use of electromagnets including an amount of current through the coils, adjusting the core ferromagnetic properties (again though material selection) or by adjusting the cold winding density around the associated core.

Other temperature adjustment variables can include modifying the size, number, location and orientation of the assemblies (elongated and plural magnet/electromagnet and alternative conductive plates). Multiple units or assemblies can also be stacked, tiered or otherwise ganged in order to multiply a given volume of conditioned fluid which is produced.

Additional variables can include varying the designing of the conductive disk packages, such as not limited varying a thickness, positioning or configuration of a blade or other fluid flow redirecting profile integrated into the conductive plates, as well as utilizing the varying material properties associated with different metals or alloys, such including ferromagnetic, ferrimagnetic, antiferromagnetic, paramagnetic and diamagnetic properties.

Having described my invention, other and additional preferred embodiments will become apparent to those skilled in the art to which it pertains, and without deviating from the scope of the appended claims. The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

I claim:

1. A magnet magnet/electromagnet thermal conditioning blower system, comprising:

a modified cylindrical housing having a side disposed shroud in turn supporting an air or fluid influencing fan located within an inner rim defined side inlet;

a motor or input drive powering a rotating shaft supporting said air or fluid influencing fan and extending through said side inlet within said modified cylindrical housing;

said rotating shaft supporting a rotatable drum shaped conductive component within said modified cylindrical housing with air or fluid flow redirecting vanes for communicating the side inlet air or fluid flow with a radially directed outlet air or fluid flow;

magnetic or electromagnetic plates arranged in a stationary array between said side disposed shroud and said rotatable drum shaped conductive component in communication with the side inlet air or fluid flow; and upon rotating said rotatable drum shaped conductive component and said side disposed shroud relative to said magnetic or electromagnetic plates, heat being generated from creation of high frequency oscillating magnetic fields and being conducted through said rotating component for outputting within the radially directed outlet fluid flow and through an outlet of said modified cylindrical housing.

2. The invention as described in claim 1, further comprising first and second end brackets with inner bearings secured to said modified cylindrical housing for supporting said rotating shaft.

3. The invention as described in claim 1, further comprising said side disposed shroud supporting an outer periphery of said air or fluid influencing fan and anchored to a side wall of said rotatable drum shaped conductive component.

4. The invention as described in claim 3, further comprising a thickness of a side wall of said rotatable drum shaped conductive component and an adjoining wall location of said side disposed shroud being greatest proximate said magnetic or electromagnetic plates.

5. The invention as described in claim 1, said air or fluid flow redirecting vanes of said rotatable drum shaped conductive component further comprising a first inner plurality of circumferentially arrayed vanes and a second outer plurality of circumferentially arrayed vanes.

6. The invention as described in claim 5, further comprising air or fluid regulating baffles located between said first inner plurality of circumferentially arrayed vanes and said second outer plurality of circumferentially arrayed vanes to both interrupt and facilitate movement of air or fluid flow within said rotatable drum shaped conductive component through the outlet.

7. The invention as described in claim 5, further comprising a static air or fluid recirculating fan secured against said first inner plurality of circumferentially arrayed vanes for assisting in redirecting air or fluid flow outlet drawn from the magnetic or electromagnetic plates.

8. The invention as described in claim 1, further comprising a tripod shaped bracket secured at distal end locations to each of opposite sides of said modified cylindrical housing for supporting said rotating shaft within a central width extending location through an interior of said modified cylindrical housing.

9. The invention as described in claim 3, further comprising cooling vents within said side disposed shroud which facilitate the passage of additional air or fluid flows in and around the magnet or electromagnetic plates.

* * * * *